US006775887B2

(12) United States Patent
Brockmanns

(10) Patent No.: US 6,775,887 B2
(45) Date of Patent: Aug. 17, 2004

(54) SYSTEM FOR THE NEEDLE-TREATMENT OF A CONVEYABLE FIBER BAT

(75) Inventor: Karl-Josef Brockmanns, Willich/Anrath (DE)

(73) Assignee: Trutzschler GmbH & Co. KG., Monchengladbach (DE)

( * ) Notice: Subject to any disclaimer, the term of this patent is extended or adjusted under 35 U.S.C. 154(b) by 43 days.

(21) Appl. No.: 10/223,701

(22) Filed: Aug. 20, 2002

(65) Prior Publication Data

US 2003/0037419 A1 Feb. 27, 2003

(30) Foreign Application Priority Data

Aug. 21, 2001 (DE) ..... 101 40 864

(51) Int. Cl.[7] ..... D04H 18/00
(52) U.S. Cl. ..... 28/107; 28/113
(58) Field of Search ..... 28/165, 107, 114, 28/113, 111, 109, 115, 103, 108, 110, 112, 214, 247; 19/98, 99, 100, 101, 112

(56) References Cited

U.S. PATENT DOCUMENTS

| | | | | | |
|---|---|---|---|---|---|
| 1,454,049 | A | * | 5/1923 | Genung | 442/321 |
| 3,208,125 | A | * | 9/1965 | Hall et al. | 28/219 |
| 3,372,447 | A | | 3/1968 | Williams et al. | |
| 3,909,891 | A | * | 10/1975 | Dilo | 28/109 |
| 4,457,055 | A | * | 7/1984 | Ambrose et al. | 28/111 |
| 4,756,062 | A | * | 7/1988 | Kis | 28/107 |
| 4,856,152 | A | * | 8/1989 | Kis | 28/114 |
| 5,533,242 | A | * | 7/1996 | Profe | 28/107 |
| 5,909,883 | A | | 6/1999 | Jourde et al. | |
| 6,065,194 | A | | 5/2000 | Dilo | |
| 6,158,097 | A | | 12/2000 | Dilo | |
| 6,347,440 | B1 | * | 2/2002 | Duval et al. | 28/107 |

FOREIGN PATENT DOCUMENTS

| | | |
|---|---|---|
| AT | 259 246 B1 | 1/1968 |
| DE | 2630514 C2 | 12/1983 |
| DE | 3822652 A1 | 2/1989 |
| DE | 4422844 A1 | 1/1996 |
| FR | 2110939 | 6/1972 |
| GB | 1510376 | 5/1978 |
| JP | 11-302965 | 11/1999 |
| SU | 825726 | 9/1978 |

* cited by examiner

*Primary Examiner*—Amy B. Vanatta
(74) *Attorney, Agent, or Firm*—Venable LLP; Robert Kinberg; Stuart I. Smith

(57) ABSTRACT

A system for the needle treatment of a conveyable fiber bat is provided with at least one conveying device having a plurality of needles that can be inserted into and withdrawn from a fiber bat. At least one rotating cylinder is provided to make possible a high needle-treatment speed and a uniform structure of the needle-felted fiber bat. The outside of this rotating cylinder forms a conveying surface for the fiber bat. The needles can pass through the conveying device from the inside toward the outside. The needles penetrate the fiber bat perpendicular to the conveying direction and then withdraw. The outside of the rotating cylinder, the fiber bat, and the needles have a similar speed in the conveying direction during the needle-treatment.

26 Claims, 13 Drawing Sheets

Fig. 9a
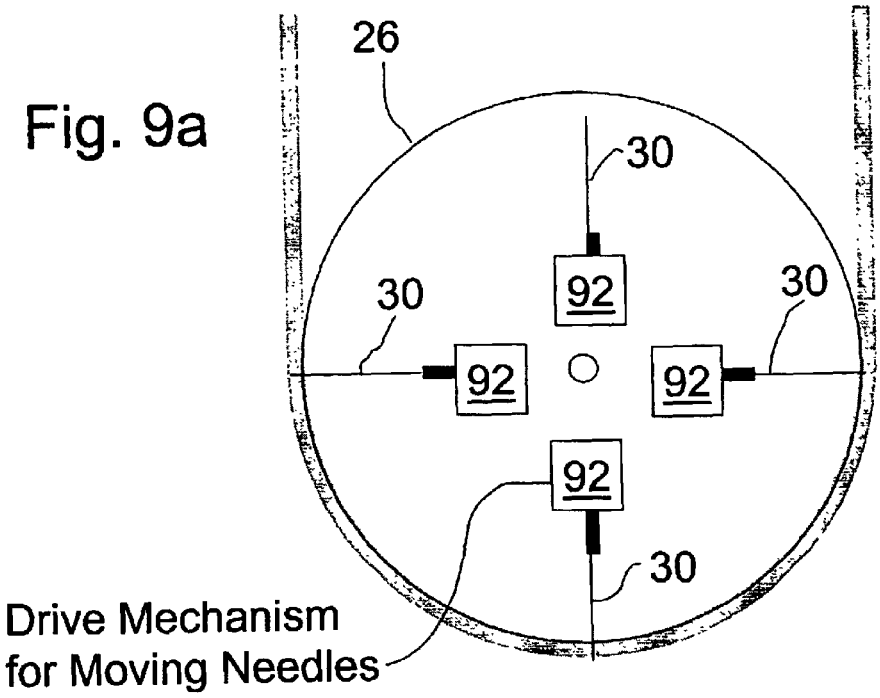
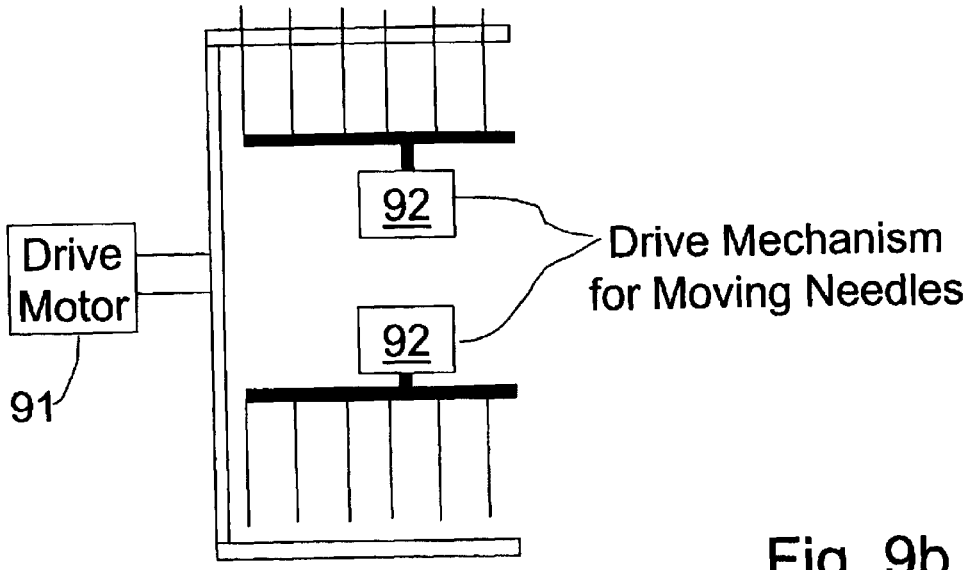
Fig. 9b

SYSTEM FOR THE NEEDLE-TREATMENT OF A CONVEYABLE FIBER BAT

CROSS-REFERENCE TO RELATED APPLICATION

This application claims the priority of German Patent Application No. 101 40 864.1 filed on Aug. 21, 2001, the disclosure of which is being incorporated herein by reference.

BACKGROUND OF THE INVENTION

The invention relates to a system for the needle-treatment of a conveyable fiber bat, and more particularly to a system which includes at least one conveying device having a plurality of needles which are pushed into and subsequently withdrawn from the fiber bat.

The fiber bat is subjected to tension during fiber-bat processing when the needles, which are inserted into the fiber bat during the needle-treatment, restrain a continuous conveyance of the fiber bat. This tension can lead to an undesirable stretching of the fiber bat in the conveying direction. U.S. Pat. No. 5,909,883A discloses a system in which the withdrawing roller drive is controlled so that the conveying speed is reduced during the needle intervention to take into account the tension on the fiber bat which increases when the needles penetrate into the material. However, this is tied to a comparably high design and control expenditure. Less complicated means for lowering the tensile stress of the fiber bat during the needle insertion are disclosed in Austrian Patent No. 259,246B1, in which one of the two rollers of a roller pair is designed with diametrically opposite arranged driver cams for the fiber bat. In dependence on the lift frequency of the needle board, the roller is operated such that a frictional connection between conveying rollers and fiber bat exists only if the needles of the needle board release the fiber bat. Such an intermittent conveying drive for the fiber bat represents an advantageous condition for a needle-treatment of the fiber bat with little tension. However, this intermittent conveying effect also requires a uniform thickness of the fiber bat that cannot be ensured in practical operations. Unavoidably thick and thin areas in the fiber bat result in irregularities in the advancement of the fiber bat and thus also in an irregular needle-treatment. Furthermore, thickened areas in the fiber bat can result in damage to the fiber bat surface, caused by the driver cams of one of the conveying rollers impacting on the fiber bat, and can lead to a mechanical overload of these conveying rollers, in particular in the bearing region. Another disadvantage is that a high operating speed is not possible with the known intermittent operation of the needle. According to a prior suggestion, the needles are rigidly arranged on the outside surface of a belt that circulates endlessly around two deflection rollers. In the process, a relative movement occurs between needles and fiber material, which pulls the fiber material out of shape. Specifically, when the needles are pushed in and pulled out of the fiber material at the two deflection locations, relative movements between the needles and the fiber material occur because of the slanted positioning of the needles relative to the fiber material. These movements lead to a stretching in the conveying direction and, in particular, to an irregular structure of the fiber material.

SUMMARY OF THE INVENTION

It is an object of the invention to provide a device of the aforementioned type that avoids the above-mentioned disadvantages and, in particular, makes it possible to have a high needle-treatment speed and a uniform structure of the needle-treated fiber bat. The conveying device can form part of a needle-treatment system.

The above and other objects are achieved according to the invention by the provision of a system for performing a needle treatment operation on a conveyable fiber bat, comprising: at least one circulating endless conveying device having an outside constituting a conveying surface for the fiber bat and an inside; a plurality of wire needles positioned for penetrating the conveying surface from the inside toward the outside and back again, and for being pushed into and withdrawn from the fiber bat; and, means for moving the conveying surface, the fiber bat, and the needles at the same speed during the needle-treatment operation.

A high needle-treatment speed and a uniform fiber bat structure are attained with the conveying device according to the invention since the conveying surface or surfaces, the fiber bat, and the needles, during penetration and withdrawal, have the same speed in the conveying direction; moreover, the needles penetrate and are withdrawn from the fiber bat in a direction perpendicular or nearly perpendicular to the fiber bat conveying direction during the needle-treatment operation. A careful and effective needle-treatment of the fiber bat, i.e., the fiber material, thus occurs without any relative speed between the fiber bat and the needles during the conveying operation. The conveying device imparts this careful needle-treatment to a range of fiber bats, including thick fiber bats and fiber bats with short fibers. A high throughput speed can be attained with the conveying device. The extended penetration phase contributes to the high throughput speed. Further advantages of the device are low weight, compact design, and low noise during operation. The design of the device permits a modular construction. The needle treatment can be realized on one side or on two sides of the fiber bat.

BRIEF DESCRIPTION OF THE DRAWINGS

FIG. 9*a* is a sectional side view of another embodiment of the conveying device according to the invention.

FIG. 9*b* is a partial sectional front view of the embodiment of the conveying device in FIG. 9*a*.

DETAILED DESCRIPTION OF THE INVENTION

Figure 1:
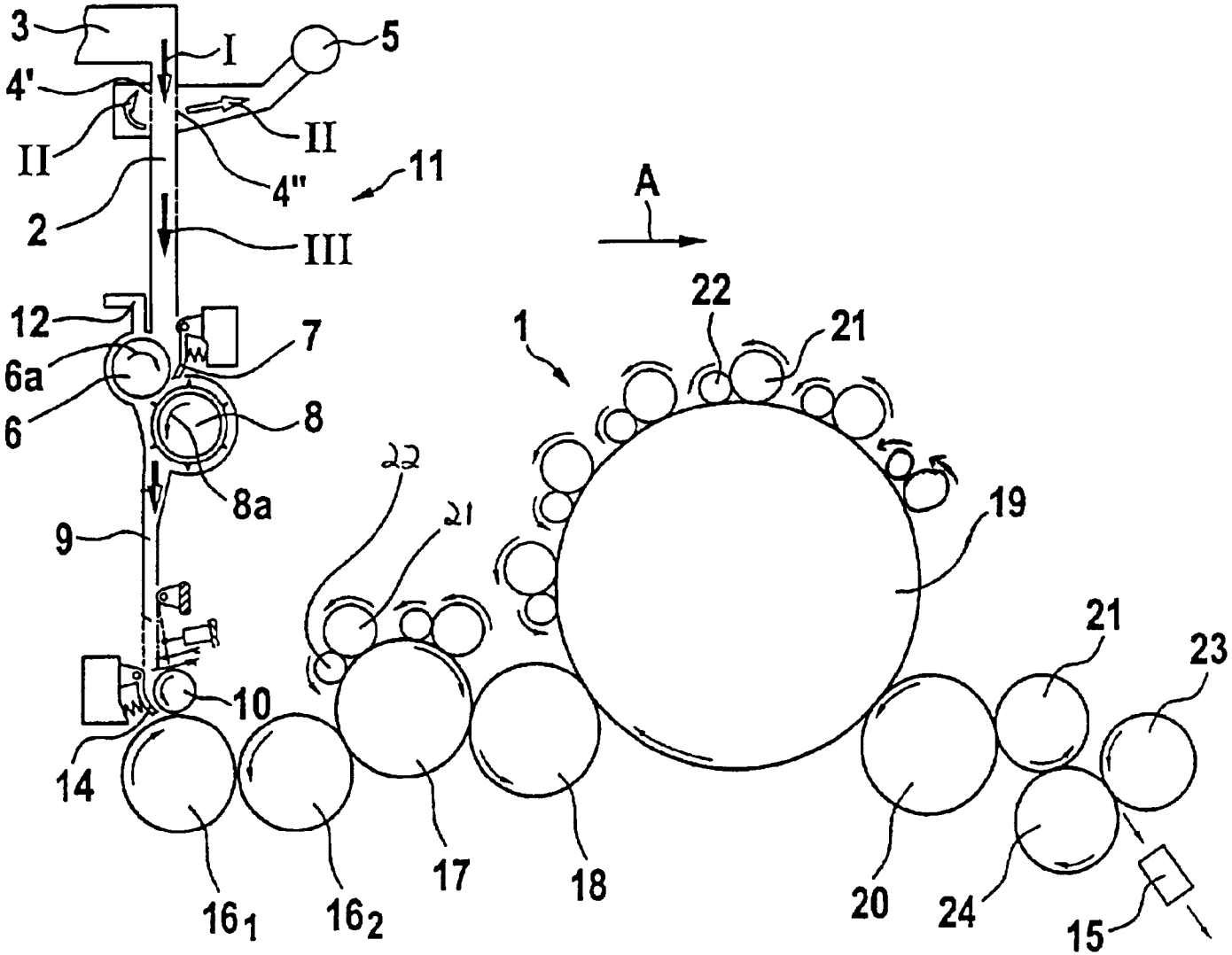
FIG. 1 is a side view of a roller-carding unit with a card unit feeder and the conveying device according to the invention.

FIG. 1 shows a roller-carding feeder 11 in conjunction with a roller-carding unit 1. The roller-carding feeder 11 will first be described. A vertical reserve chute 2 is fed from above with the finely broken up fiber good I, for example via a condenser and through a feeding and distribution line 3. Air outlet openings 4' and 4" are provided in an upper region of the reserve chute 2 through which transport air II is pulled by a suctioning device 5 following separation from fiber goods or floccules III. A feed roller (intake roller) 6 operating jointly with a feeding trough 7 closes off a lower end of the reserve chute 2. With this slow-rotating feed roller 6, the fiber goods III from the reserve chute 2 are supplied below to a fast-moving opening roller 8, provided with pins or saw-tooth wire, and making contact along a portion of its circumference with a lower feeding chute 9. The opening roller 8, rotating in the direction of arrow 8*a*, conveys the fiber goods III into the feeding chute 9. The feed roller 6 rotates slowly in a clockwise direction (arrow 6*a*) and the opening roller 8 rotates in a counterclockwise direction (arrow 8*a*), so that opposite rotational movements are realized. The feeding chute 9 is provided at the lower end with a withdrawing roller 10, rotating in the direction shown by the drawn arrow, and a feed trough 14 which places the fiber goods into the roller-carding unit 1. An example of this roller-carding feeder 11, is a SCANFEED unit manufactured by the company Trützschler in Mönchengladbach, Germany.

The feed roller 10 and the feed trough 14 of the roller-carding feeder 11 are followed in the conveying direction A of the roller-carding unit 1 by a first uptake roller $\mathbf{16}_1$, a second uptake roller $\mathbf{16}_2$, a licker-in cylinder 17, a transfer roller 18, and a main carding cylinder 19. Two roller pairs $\mathbf{16}_1$ an $\mathbf{16}_2$ are associated with the licker-in cylinder 17 and six roller pairs are associated with the main carding cylinder 19; each roller pair consists of a stripping roller 21 and a clearer 22. Immediately adjoining and cooperating with the main carding cylinder 19 is a doffer 20 and a stripping roller 21 which serves as a calender roller. Two calender rollers 23 and 24 follow the stripping roller 21. The conveying device 15 according to the invention is located downstream of the calender rollers 23 and 24.

Alternately, the conveying device 15 according to the invention can be installed downstream of an aerodynamic fiber-bat former (not shown herein), instead of downstream of a roller-carding unit 1. The conveying device 15 can also follow a carding machine provided with at least one crushing cylinder for creating a heavier fiber bat.

Figure 2:
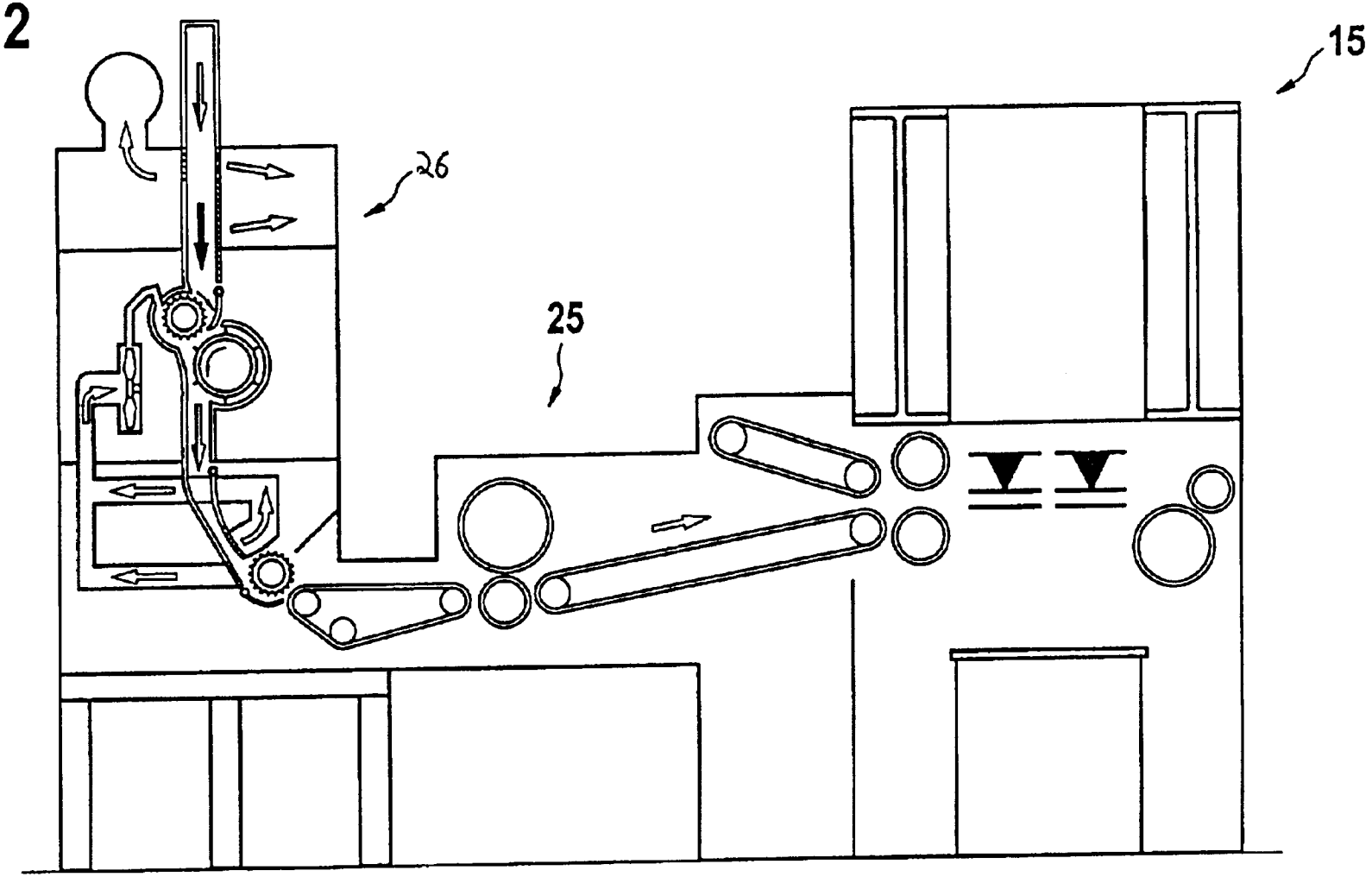
FIG. 2 is a side view of a floccule feeder directly connected to the conveying device according to the invention.

According to FIG. 2, a floccule feeder 26, for example, a SCANFEED FBK 5000, manufactured by the company Tr ützschler in Mönchengladbach, Germany, is directly connected to the conveying device 15. Transfer devices 25, e.g. circulating endless conveying belts and conveying rollers can be arranged between the floccule feeder 26 and the conveying device 15 according to the invention. An operating width of five meters is possible.

Figure 3A:
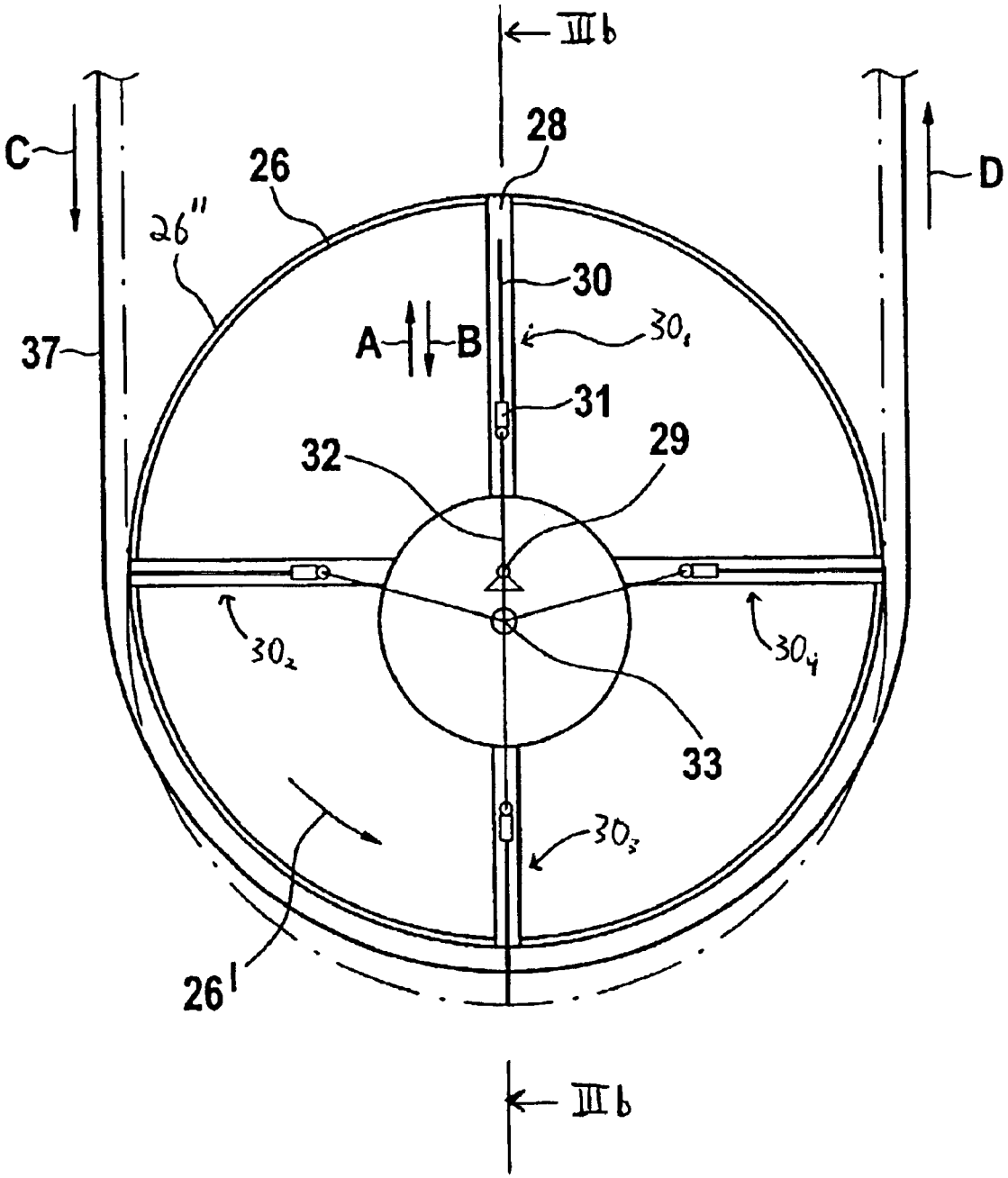
FIG. 3*a* is a sectional side view of an embodiment of the conveying device shown in FIG. 3*b*.
Figure 3B:
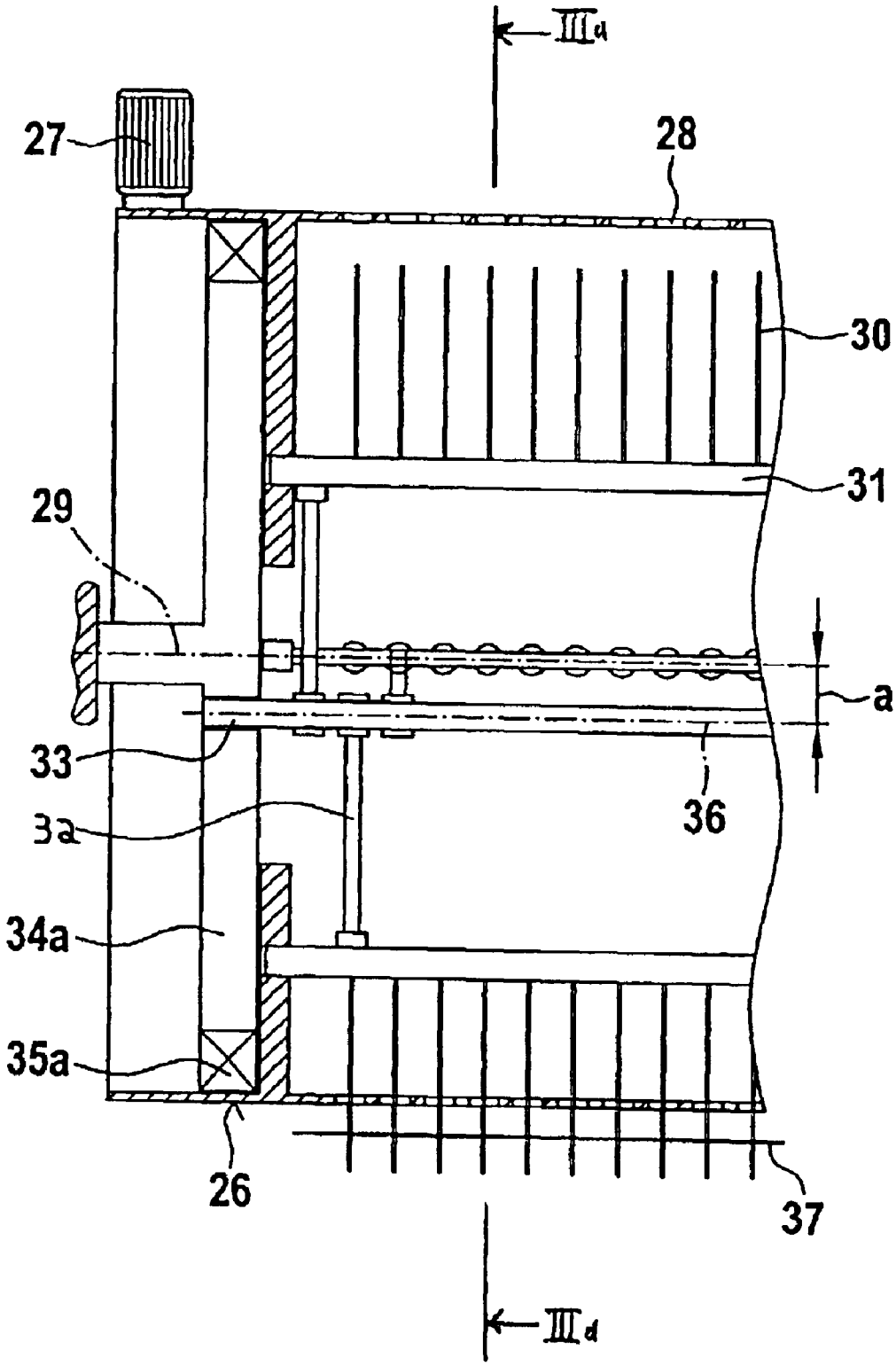
FIG. 3*b* is a partial sectional front view of the conveying device shown in FIG. 3*a*.

FIG. 3*a* is a sectional side view of the conveying device and corresponds to the section IIIa taken through FIG. 3*b*. FIG. 3*b* is a partial sectional front view of the conveying device and corresponds to the section IIIb taken through FIG. 3*a*.

According to FIG. 3*a*, a rotating cylinder 26 rotates in the direction of arrow 26' and is driven by a drive motor 27. The fiber bat 37 moves in the direction indicated by arrow C towards the rotating cylinder 26, on the surface of the outer shell surface of the rotating cylinder 26, and away from the rotating cylinder 26 in the direction indicated by arrow D. A plurality of openings 28 penetrate through the outer shell of rotating cylinder 26, which can be a tubular body. Four longitudinal rows of openings 28 are arranged over the circumference of the rotating cylinder 26. As shown in FIG. 3*a*, the rows are equally spaced at 90° angles around the rotating cylinder axis 29. As seen in FIG. 3*b*, the openings 28 within a row are arranged side-by-side. Within the rotating cylinder 26 are four rows of radially moveable needles 30. The rows are arranged equally spaced at 90° angles around the rotating cylinder axis 29. As seen over the width of the rotating cylinder 26 (see FIG. 3*b*), each row contains a plurality of needles 30, arranged side-by-side. Each needle row $\mathbf{30}_1$, $\mathbf{30}_2$, $\mathbf{30}_3$, and $\mathbf{30}_4$ is constrained by two side guides between which the needles 30 can move back and forth in the direction of arrows A and B along a straight line extending between an opening 28 and the rotating cylinder axis 29. The free end of needles 30 can be pushed through and withdrawn from the openings 28. The other end of the needles 30 in a needle row is embedded in a needle board 31; each needle row has an associated needle board. One end of a connector rod 32 is mounted such that it can pivot on a needle board 31 and the other end such that it can rotate on a needle-actuation shaft 33; each needle board has at least one associated connector rod 32. The rotating cylinder 26 is provided on each of its two ends with locally fixed end plates only 34*a* is shown in FIG. 3*b*. A bearing 35*a* is provided between the circumferential face of the end plate 34*a* and the inside shell surface of the rotating cylinder 26. A similar bearing is provided at the other end of the rotating cylinder 26 between the non-illustrated end plate and the inside shell surface of the rotating cylinder. The needle-actuation shaft 33 is received in the end plates. The rotating cylinder axis 29 and the needle-actuation shaft axis 36 are arranged parallel with respect to each other with a distance a between them.

Figure 4A:
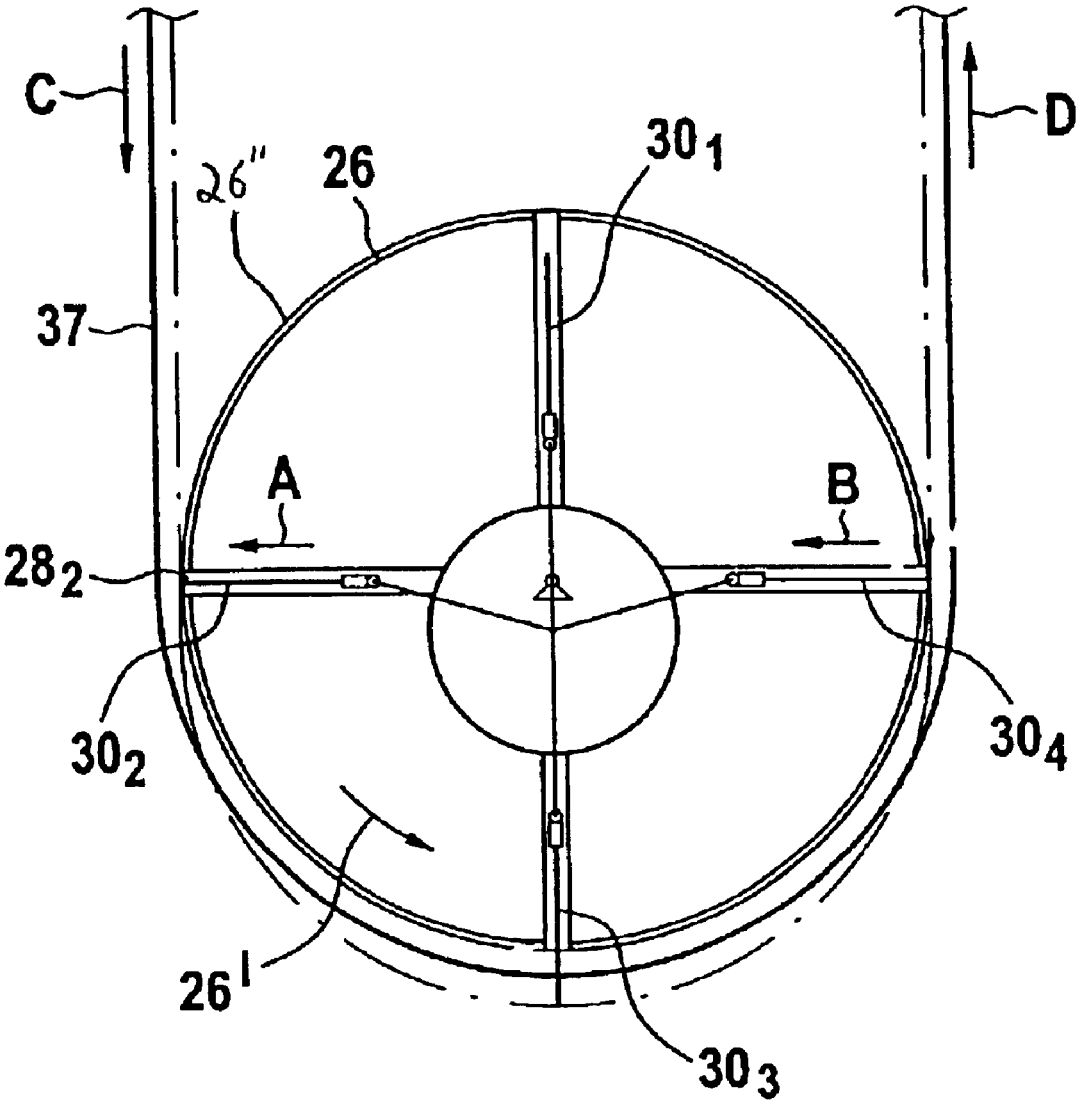
FIGS. 4*a* through 4*c* are sectional side views of the of the conveying device which show the position of components of the conveying device at successive times.
Figure 4B:
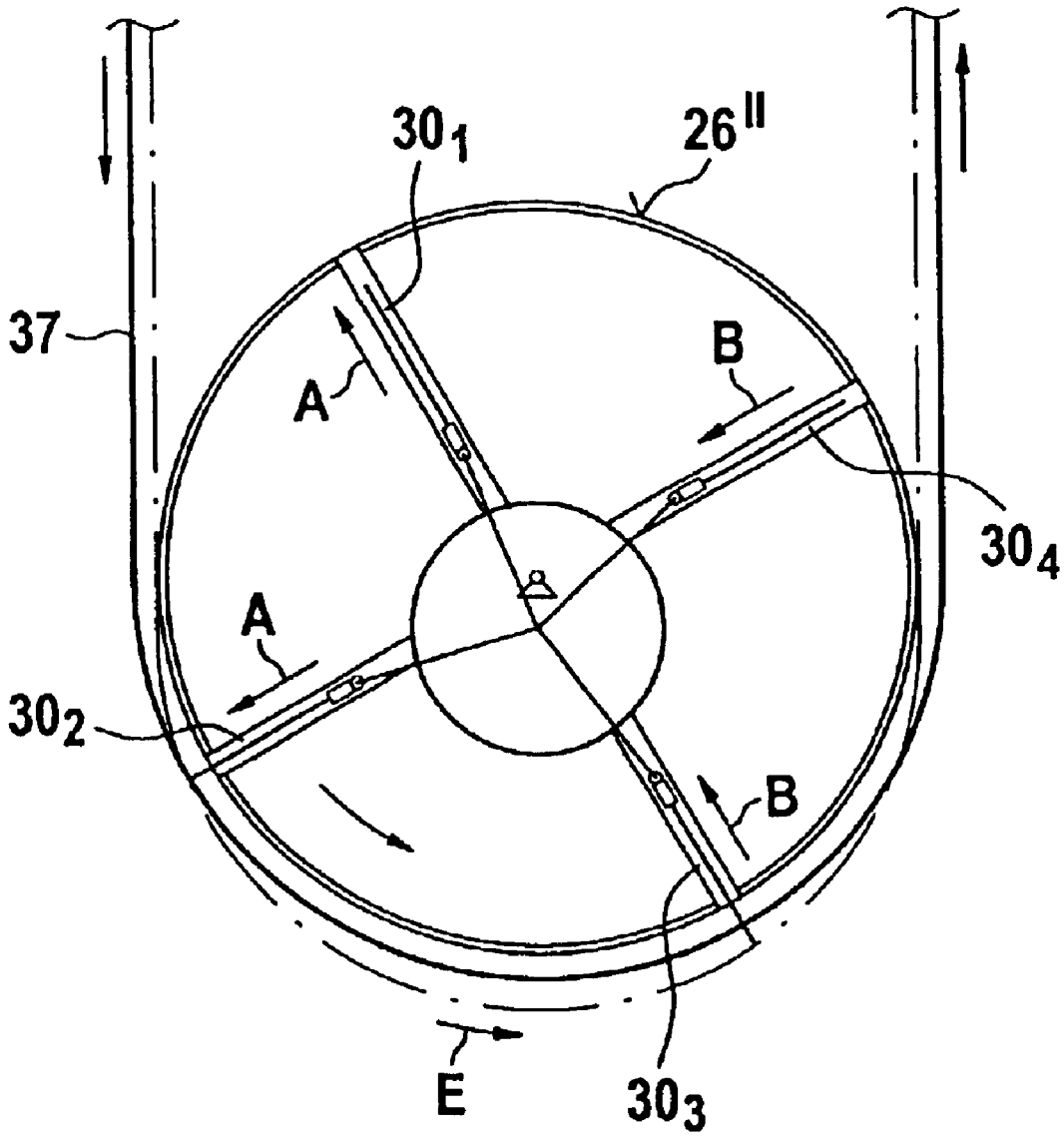
Figure 4C:
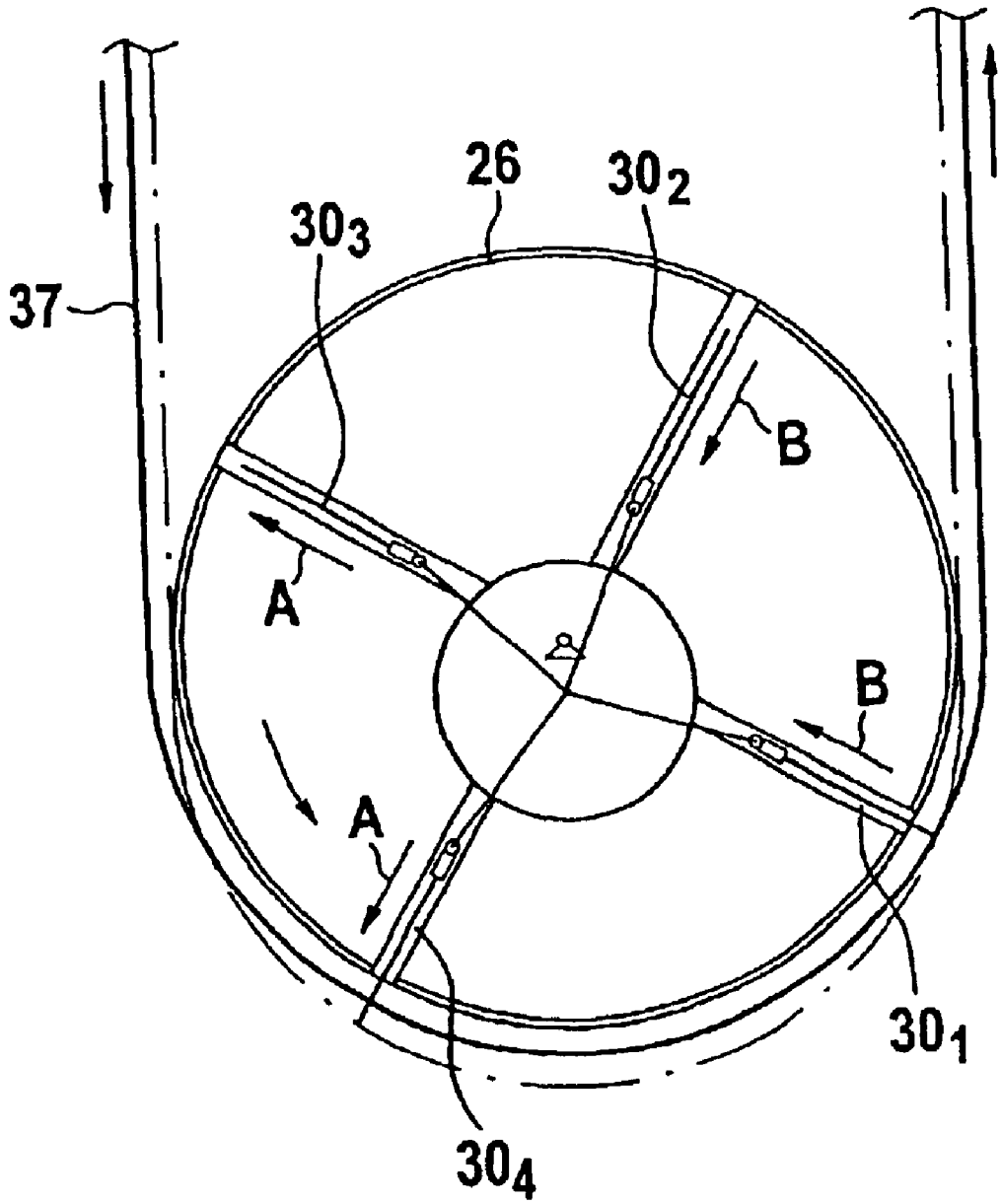

FIGS. 4*a* through 4*c* show that during the needle-treatment operation the fiber bat 37 initially moves in a straight line tangentially towards the rotating cylinder 26, as indicated by arrow C, in order to receive needle treatment. Subsequently, the fiber bat 37 moves circumferentially with the outer shell surface 26" of the rotating cylinder 26 as shown by arrow E. Finally, the fiber bat 37 moves once more in a straight line away from rotating cylinder 26 in the direction of arrow D. The rotating cylinder 26 rotates with a high speed in the direction of arrow 26'. According to FIG. 4*a*, at point in time $t_1$, the needles 30 in the needle row $\mathbf{30}_1$ are positioned completely inside of the rotating cylinder 26. The needles 30 in the needle row $\mathbf{30}_2$ penetrate the openings $\mathbf{28}_2$ and start to penetrate the fiber bat 37 in the direction of arrow A. The needles 30 in the needle row $\mathbf{30}_3$ completely penetrate the fiber bat 37, whereas the needles 30 in the needle row $\mathbf{30}_4$ are in the process of being withdrawn from the fiber bat 37 in the direction of arrow B. According to FIG. 4*b*, at a later point in time $t_2$, the fiber bat 37 has been advanced in the direction of arrows C, D and E. It is essential that the conveying surface, i.e., the outer shell surface 26" of rotating cylinder 26, the fiber bat 37, and the needles 30 have the same speed in the conveying direction during the needle treatment, from the start of penetration of the needles 30 into the fiber bat, through full penetration and complete withdrawal of the needles. The needle rows $\mathbf{30}_1$ through $\mathbf{30}_4$ in FIG. 4*b* are in a different position than in FIG. 4*a*. According to FIG. 4*c*, the rotating cylinder 26 at an even later point in time $t_3$ has performed nearly a three-quarters rotation with respect to its position in FIG. 4*a*. The needle rows $\mathbf{30}_1$ and $\mathbf{30}_2$ are being withdrawn from fiber bat 37 in the direction of arrow B while the needle rows $\mathbf{30}_3$ and $\mathbf{30}_4$ are moving in the direction of arrow A towards the fiber bat 37. While the rotating cylinder 26 rotates, the needles 30 perform two movements simultaneously: they perform a back and forth movement in the direction of arrows A and B while moving along a circular path shown by arrow 26'.

FIGS. 3*a* and 3*b* show an embodiment in which all movements of the conveying device, e.g., the rotational movement of the rotating cylinder 26 and the linear movements of the needles 30, are mechanically derived from a single drive motor.

Figure 5:
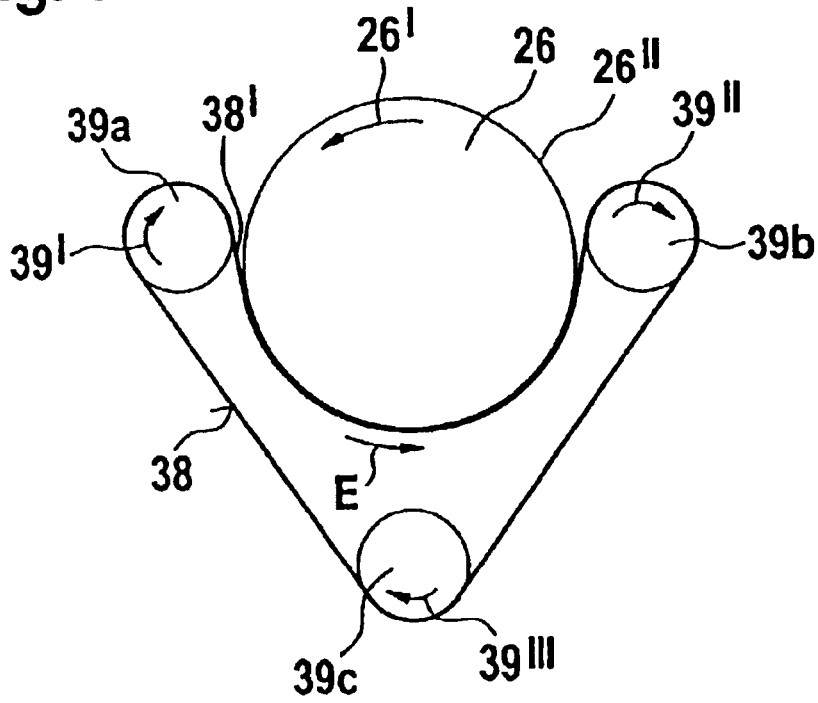
FIG. 5 is a side view of the conveying device which includes a circulating endless perforated belt.

An endless perforated belt 38 which serves as a stitch bed circulates around three deflection rollers 39*a*, 39*b*, and 39*c*, as shown in FIG. 5. The rotational direction of the deflection rollers 39*a*, 39*b*, and 39*c* is indicated with the curved arrows 39', 39" and 39'". The fiber bat 37 (not shown in FIG. 5) is guided and conveyed between the curved outside 38' of the perforated belt 38 and the outer shell surface 26" of rotating cylinder 26 which rotates in the direction shown by arrow 26'. It is essential that the perforated belt 38, the outside 38' of which forms another conveying surface, the outer shell surface 26" of rotating cylinder 26, the fiber bat, and the needles (not shown in FIG. 5) have the same speed in the conveying direction shown by arrow E during the needle-treatment. The belt forms part of the entire conveying device.

Figure 6A:
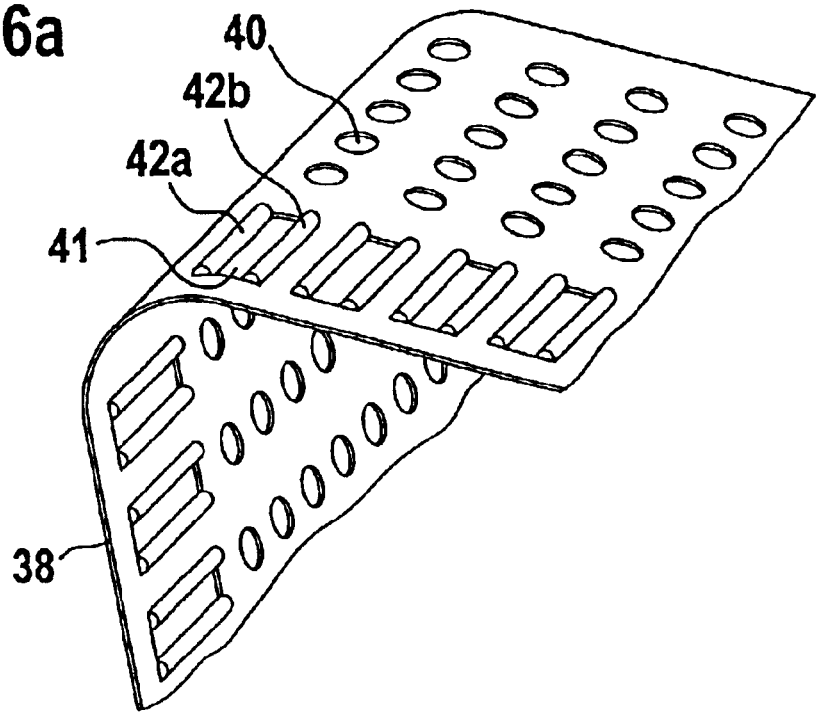
FIG. 6*a* is a perspective view of a portion of the endless perforated belt depicted in FIG. 5.
Figure 6B:
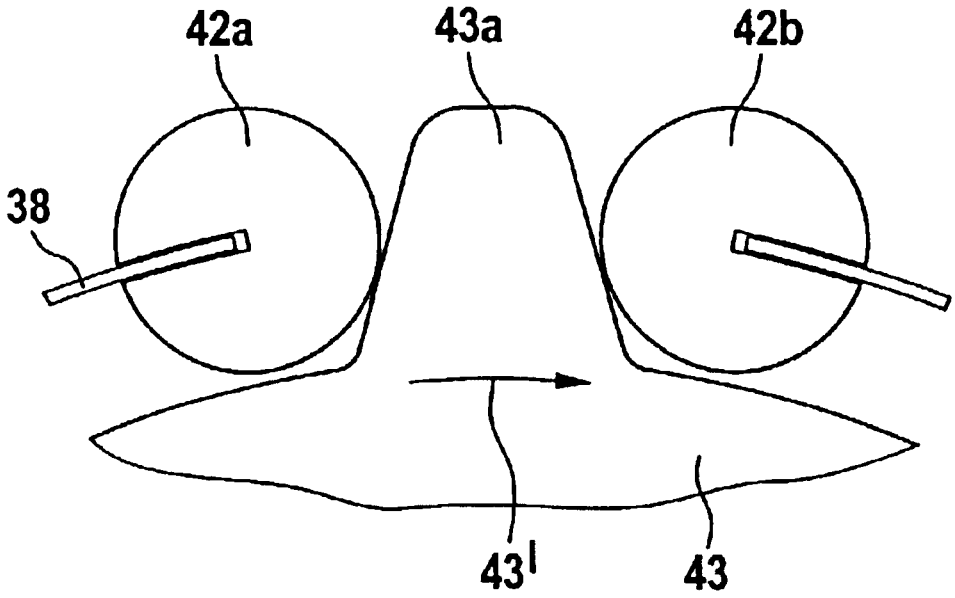
FIG. 6*b* is a side view of a drive mechanism for the endless perforated belt.

FIG. 6*a* shows the deflection of the perforated belt 38 with openings 40 around a belt deflection device (not shown in FIG. 6*a*). Successive recesses 41 which penetrate through perforated belt 38 are provided in one edge region (as shown) or in both edge regions of perforated belt 38. The edges bounding the recesses in the conveying direction of perforated belt 38 are reinforced with edge-reinforcing elements 42*a* and 42*b* against wear and tear. The edge-reinforcing elements 42*a* and 42*b* have rounded outer surfaces. As shown in FIG. 6*b*, the teeth 43*a* of a toothed wheel 43 extend through the recesses of the perforated belt 38. The toothed wheel is driven (in a manner not shown herein) by a device, e.g., a drive motor, in the direction of the curved arrow 43'.

Figure 7:
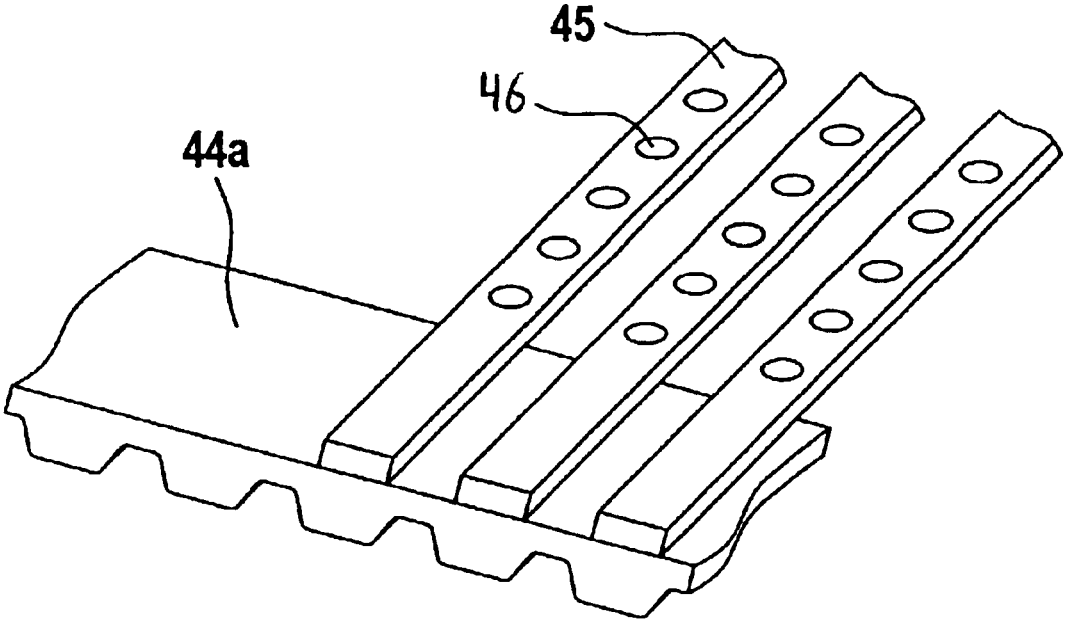
FIG. 7 is a perspective view of an alternate embodiment of the endless perforated belt.

In another embodiment of the stitch bed shown in FIG. 7, the circulating endless perforated belt is an endless ladder belt formed by two endless toothed belts, only one belt 44*a* being shown herein. A plurality of strips 45 span between the outside of the endless toothed belts. The strips 45 have openings 46 through which the needles (not shown in FIG. 7) can penetrate. Gearwheels (not shown in FIG. 7) are used to drive the toothed belts.

In yet another embodiment (not shown herein), the stitch bed is formed of a mesh material.

Belts which serve as stitch beds can be formed of any one of a number of materials, including steel.

Figure 8A:
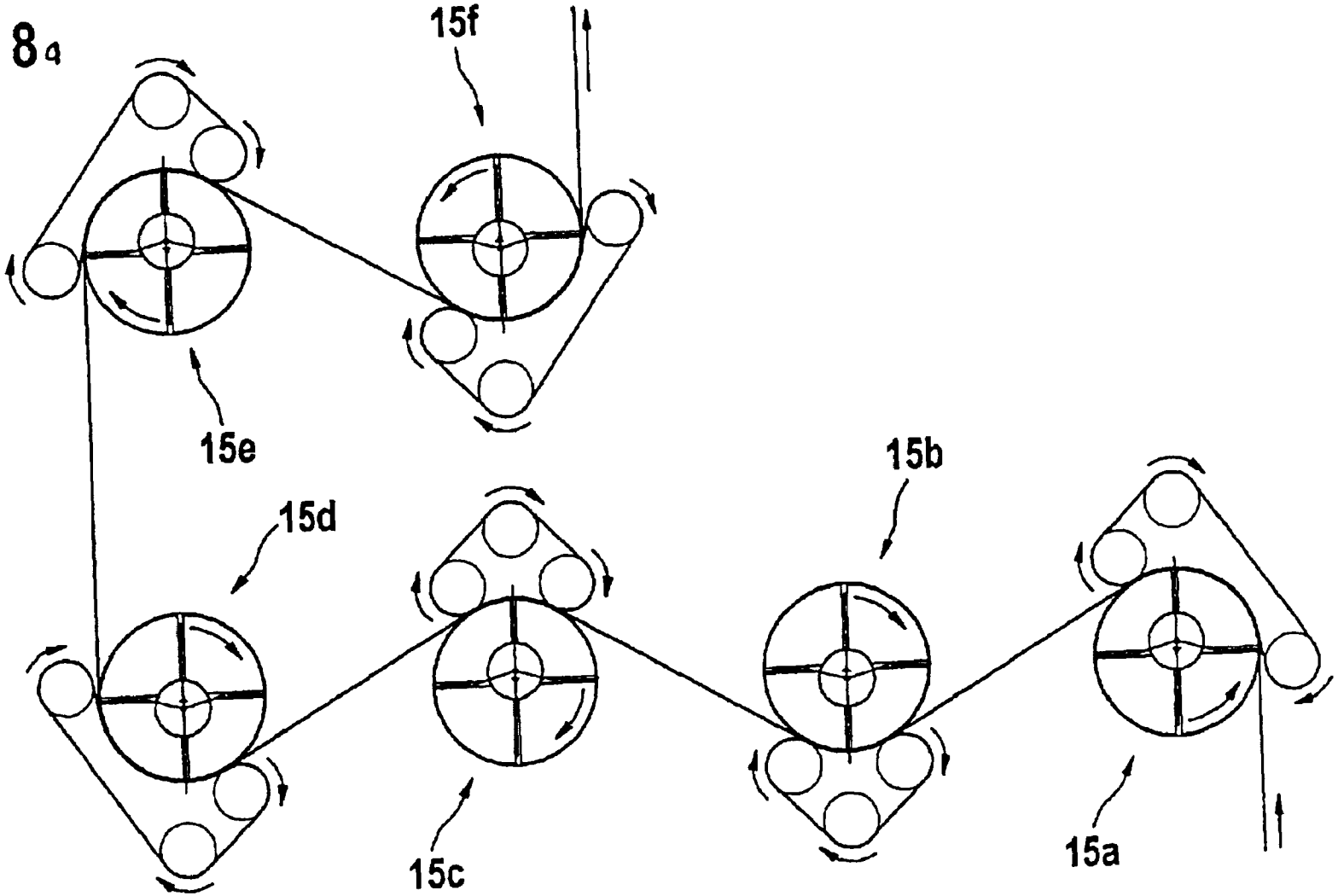
FIG. 8*a* is a side view of a plurality of serially connected conveying devices.
Figure 8B:
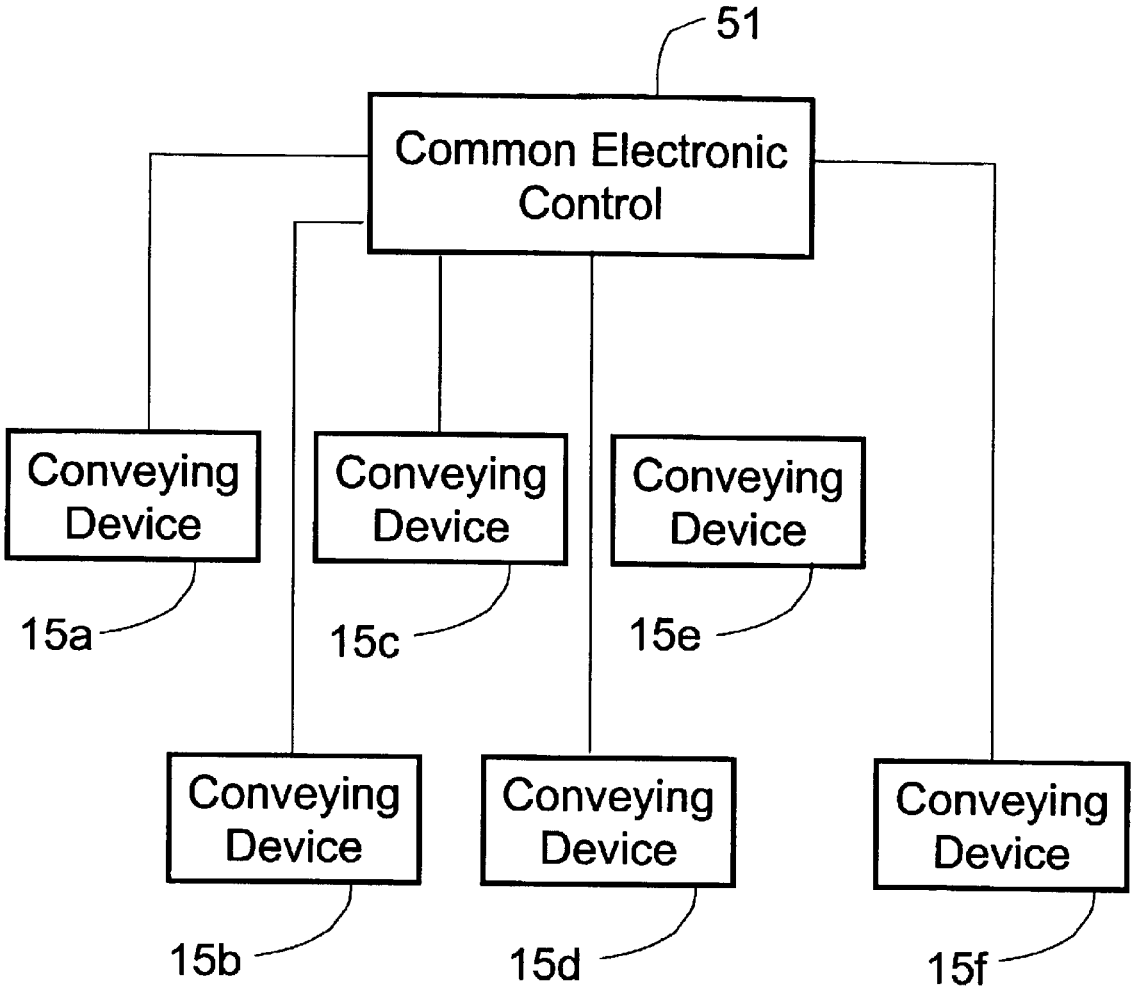
FIG. 8*b* is a block diagram of a common electronic control connected to drive motors and drive mechanisms for moving the needles associated with a plurality of conveying devices according to the invention.

FIG. 8*a* shows a needle-treatment system composed of a plurality of conveying devices 15*a* through 15*f* according to the invention that are serially connected. The drive motors and drive mechanisms for moving the needles for the conveying devices 15*a* through 15*f* are connected to a common electronic control 51, shown in FIG. 8*b*, for coordinating the conveying and needle speeds of the conveying devices relative to each other; the conveying speeds and the needle speeds of any two of the conveying devices in the needle treatment system can be identical or different.

In the embodiment of the conveying device shown in FIGS. 9*a* and 9*b*, a drive motor 91 drives the rotational movement of the rotating cylinder 26 and separate drive mechanisms 92 for moving the needles drive the linear movements of the needles 30.

Figure 10:
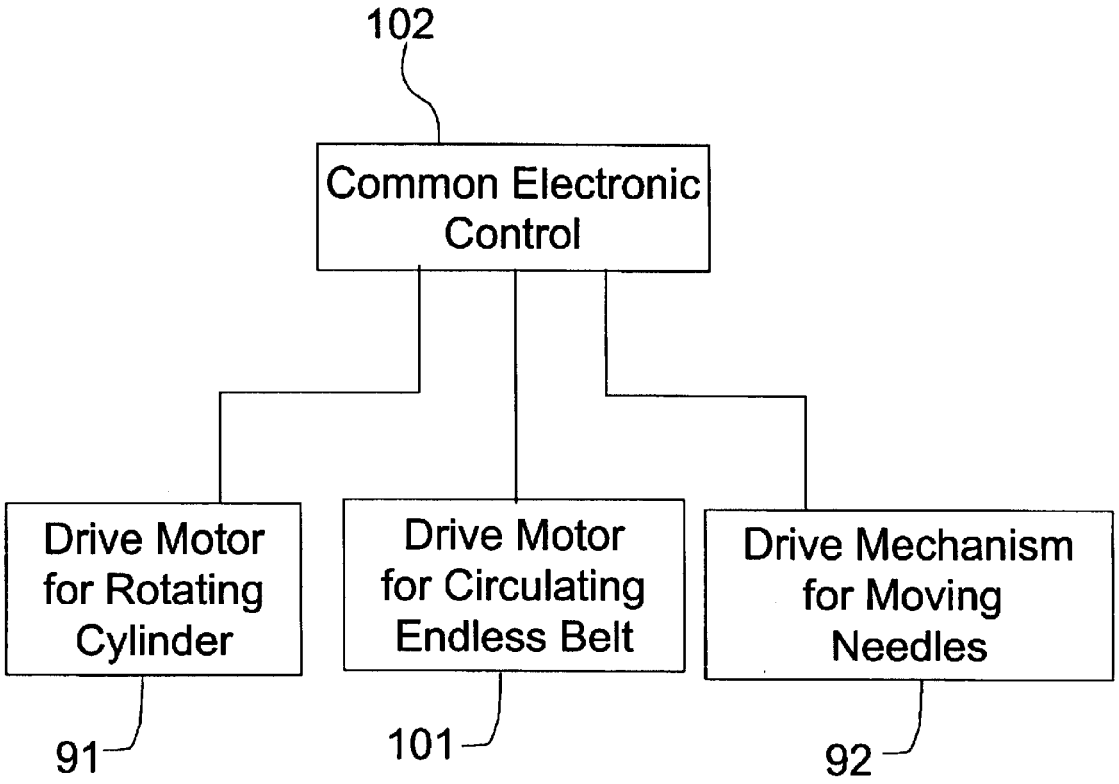
FIG. 10 is a block diagram of a common electronic control connected to drive motors and drive mechanisms for moving the needles associated with a conveying device according to the invention.

In an embodiment, shown in FIG. 10, the drive motor 91 for the rotating cylinder, the drive motor or motors 101 for a circulating endless belt, and the drive mechanism or mechanisms 92 for moving the needles can be connected to a common electronic control 102. The common electronic control 102 coordinates the drive motors 91 and 101 and drive mechanisms 92 for moving the needles to ensure that the rotating cylinder, needles, fiber bat, and circulating endless belt all travel with the same speed in the conveying direction. The common electronic control 102 controls the points in time of insertion and of removal of the needles.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A system for performing a needle treatment operation on a conveyable fiber bat, comprising:

at least one circulating endless conveying device having an outside constituting a conveying surface for the fiber bat and an inside;

a plurality of wire needles positioned for penetrating the conveying surface from the inside toward the outside and back again, and for being pushed into and withdrawn from the fiber bat, the needles being mounted on a needle board;

a needle actuation shaft about which the needle board rotates;

a connecting rod having a first end that is pivotably connected to the needle board, and a second end that is rotatably connected to the needle actuation shaft; and means for moving the conveying surface, the fiber bat, and the needles at the same speed during the needle-treatment operation.

2. The system according to claim 1, wherein the conveying device includes a rotating cylinder.

3. The system according to claim 1, wherein the conveying device includes a circulating endless belt and at least two belt deflection rollers about which the endless bolt travels.

4. The system according to claim 1, further including a stitch bed located so that the fiber bat can be arranged between the conveying device and the stitch bed.

5. The system according to claim 4, wherein the stitch bed has an outside that constitutes another conveying surface.

6. The system according to claim 4, wherein the conveying device and the stitch bed are arranged so that the fiber bat is compacted therebetween.

7. The system according to claim 4, wherein the stitch bed comprises a circulating endless conveying device.

8. The system according to claim 4, further comprising means for moving the stitch bed at the same speed as the fiber bat.

9. The system according to claim 4, wherein the stitch bed has openings for the needles to pass through.

10. The system according to claim 1, wherein the needles are arranged for being pushed into and pulled out of the fiber bat with a movement that is substantially perpendicular to the fiber bat.

11. The system according to claim 1, wherein the conveying device has openings for the needles to pass through.

12. The system according to claim 1, wherein the conveying device comprises a plurality of conveying devices connected one behind the other for serial treatment of the fiber bat.

13. The system according to claim 1, further comprising a drive mechanism for moving the needles and a drive control device connected to the drive mechanism.

14. The system according to claim 13, wherein the control device controls the movement of the needles.

15. The system according to claim 14, wherein the control device controls the instant for inserting the needles and for withdrawing the needles.

16. The system according claim 1, further comprising at least one drive motor arranged for driving the conveying device and the needles.

17. The system according to claim 1, further comprising a drive motor and means for deriving movement of the conveying device and the needles from the drive motor.

18. A system for performing a needle treatment operation on a conveyable fiber bat, comprising:

at least one circulating endless conveying device having an outside constituting a conveying surface for the fiber bat and an inside;

a plurality of wire needles positioned for penetrating the conveying surface from the inside toward the outside and back again, and for being pushed into and withdrawn from the fiber bat;

means for moving the conveying surface, the fiber bat, and the needles at the same speed during the needle-treatment operation; and a stitch bed located so that the fiber bat can be arranged between the conveying device and the stitch bed, wherein the stitch bed comprises a circulating endless belt.

19. The system according to claim 18, wherein the belt is a steel belt.

20. The system according to claim 18, wherein the belt is a circulating endless ladder belt.

21. The system according to claim 18, wherein the belt is perforated.

22. A system for performing a needle treatment operation on a conveyable fiber bat, comprising:

a plurality of circulating endless conveying devices connected one behind the other for serial treatment of the fiber bat, each of the conveying devices having an outside constituting a conveying surface for the fiber bat and an inside;

a plurality of wire needles positioned for penetrating the conveying surface from the inside toward the outside and back again, and for being pushed into and withdrawn from the fiber bat; and means for moving the conveying surface, the fiber bat, and the needles at the same speed during the needle-treatment operation, wherein each of the conveying devices have different operating speeds.

23. A system for performing a needle treatment operation on a conveyable fiber bat, comprising:

a plurality of circulating endless conveying devices connected one behind the other for serial treatment of the fiber bat, each of the conveying devices having an outside constituting a conveying surface for the fiber bat and an inside;

a plurality of wire needles positioned for penetrating the conveying surface from the inside toward the outside and back again, and for being pushed into and withdrawn from the means for moving the conveying surface, the fiber bat, and the needles at the same speed during the needle-treatment operation; and at least one drive motor for driving each of the conveying devices and a common electronic control, wherein at least two of the drive motors are connected to the common electronic control.

24. The system according to claim 23, wherein the common electronic control synchronizes the speeds of the drive motors.

25. A system for performing a needle treatment operation on a conveyable fiber bat, comprising:

a plurality of circulating endless conveying devices connected one behind the other for serial treatment of the fiber bat, each of the conveying devices having an outside constituting a conveying surface for the fiber bat and an inside;

a plurality of wire needles positioned for penetrating the conveying surface from the inside toward the outside and back again, and for being pushed into and withdrawn from the fiber bat;

means for moving the conveying surface, the fiber bat and the needles at the same speed during the needle-treatment operation; and a separate drive motor for driving a respective one of the conveying devices.

26. The system according to claim 25, further including a common electronic control, wherein the motors for the plurality of conveying devices are connected to the common electronic control.

* * * * *